US010072376B2

(12) United States Patent
Choi et al.

(10) Patent No.: US 10,072,376 B2
(45) Date of Patent: Sep. 11, 2018

(54) CLOTHES TREATMENT APPARATUS

(71) Applicant: LG ELECTRONICS INC., Seoul (KR)

(72) Inventors: Jeongryeol Choi, Seoul (KR); Hyungkyu Lim, Seoul (KR); Taejun Yoon, Seoul (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 14/972,488

(22) Filed: Dec. 17, 2015

(65) Prior Publication Data

US 2016/0177497 A1 Jun. 23, 2016

(30) Foreign Application Priority Data

Dec. 19, 2014 (KR) ..... 10-2014-0184785

(51) Int. Cl.

| | |
|---|---|
| ***D06F 73/02*** | (2006.01) |
| ***D06F 39/00*** | (2006.01) |
| ***D06F 58/20*** | (2006.01) |
| ***F01K 5/00*** | (2006.01) |
| *D06F 58/10* | (2006.01) |

(52) U.S. Cl.

CPC ..... *D06F 73/02* (2013.01); *D06F 39/006* (2013.01); *D06F 58/203* (2013.01); *F01K 5/00* (2013.01); *D06F 58/10* (2013.01)

(58) Field of Classification Search

CPC ..... D06F 73/02; D06F 58/10; D06F 58/203; D06F 39/008

See application file for complete search history.

(56) References Cited

FOREIGN PATENT DOCUMENTS

| | | |
|---|---|---|
| CN | 201305779 | 9/2009 |
| EP | 2287388 | 2/2011 |
| KR | 10-2009-0050218 | 5/2009 |
| KR | 10-2009-0050621 | 5/2009 |
| KR | 10-2011-0067836 | 6/2011 |
| KR | 10-1155003 | 6/2012 |
| KR | 10-1366273 | 2/2014 |
| KR | 10-1367400 | 2/2014 |
| KR | 10-1387524 | 4/2014 |

(Continued)

OTHER PUBLICATIONS

Machine Translation of Hong et al., KR10-2009-0050218, May 2009.*

(Continued)

*Primary Examiner* — David G Cormier

(74) *Attorney, Agent, or Firm* — Fish & Richardson P.C.

(57) ABSTRACT

A clothes treatment apparatus includes a cabinet including a treatment chamber, a steam unit that is located in the cabinet and that is configured to generate steam, and a steam spray device that is located in the cabinet and that is configured to spray steam into the treatment chamber. The steam spray device includes a main body part that defines a main body space. The steam spray device includes an introduction part that is configured to allow steam that is generated by the steam unit to enter the main body space. The steam spray device includes a nozzle part that is connected to the main body part, that communicates with the main body space, and that is configured to discharge steam in the main body space into the treatment chamber. The steam spray device includes a condensed water discharge part and a partition wall.

17 Claims, 12 Drawing Sheets

(56) References Cited

FOREIGN PATENT DOCUMENTS

| | | |
|---|---|---|
| WO | 2008/065619 | 6/2008 |
| WO | 2009/064144 | 5/2009 |

OTHER PUBLICATIONS

Extended European Search Report issued in European Application No. 15201295.1 dated Apr. 4, 2016, 9 pages.
International Search Report and Written Opinion in International Application No. PCT/KR2015/013985, dated Apr. 22, 2016, 7 pages.
Chinese Office Action in Chinese Application No. 201510964205.6, dated Jun. 26, 2017, 13 pages (with English translation).

* cited by examiner

CLOTHES TREATMENT APPARATUS

CROSS-REFERENCE TO RELATED APPLICATION

This application claims the priority benefit of Korean Patent Application No. 10-2014-0184785, filed on Dec. 19, 2014 in the Korean Intellectual Property Office, the disclosure of which is incorporated herein by reference.

FIELD

The present disclosure relates to a clothes treatment apparatus.

BACKGROUND

Clothes treatment apparatuses are apparatuses that treat clothes, e.g., wash and dry clothes and smooth wrinkles in clothes, at home or at laundromats.

Clothes treatment apparatuses may be classified into a washer for washing clothes, a dryer for drying clothes, a washer/dryer having both a washing function and a drying function, a refresher for refreshing clothes, and a steamer for removing unnecessary wrinkles in clothes.

The refresher is an apparatus that keep clothes comfortable and fresh. The refresher functions to dry clothes, to supply fragrance to clothes, to prevent the occurrence of static electricity in clothes, or to remove wrinkles from clothes.

The steamer is an apparatus that simply supplies steam to clothes in order to remove wrinkles from the clothes. Unlike a general iron, the steamer removes wrinkles from the clothes without directly applying heat to the clothes.

SUMMARY

According to an innovative aspect of the subject matter described in this application, a clothes treatment apparatus includes a cabinet including a treatment chamber that is configured to receive clothes; a steam unit that is located in the cabinet and that is configured to generate steam; and a steam spray device that is located in the cabinet and that is configured to spray steam into the treatment chamber and that includes a main body part that defines a main body space; an introduction part that is connected to the main body part, that communicates with the main body space, and that is configured to allow steam that is generated by the steam unit to enter the main body space; a nozzle part that is connected to the main body part, that communicates with the main body space, and that is configured to discharge steam in the main body space into the treatment chamber; a condensed water discharge part that is connected to the main body part and that is configured to discharge condensed water out of the main body space; and a partition wall that is connected to the main body part, that is configured to partition at least a portion of the main body space into a first space and a second space, that is configured to define a gap that allows steam to flow from the first space to the second space, and that is configured to collide with steam flowing from the introduction part to the nozzle part.

The clothes treatment apparatus may include one or more of the following optional features. The introduction part is located in the first space, and the nozzle part is located in the second space. The condensed water discharge part is located in the second space. The condensed water discharge part is located in a portion of the main body space excluding the first space. The partition wall is configured to extend downward from an inner upper surface of the main body part and defines, along with an inner bottom surface of the main body part, the gap. The partition wall is located above an upper side of the introduction part. The partition wall is longer than the nozzle part. The introduction part is located at a lower side of the partition wall, and is located in the first space and the second space.

The introduction part defines an outlet that is configured to discharge steam and that opens toward the first space. The introduction part defines an outlet that is configured to discharge steam and that opens toward a side part of the steam spray device that further defines the main body space and that faces a side of the partition wall. The nozzle part is located in the second space, and the introduction part includes an outlet that is configured to discharge steam and that opens towards a direction that is opposite the nozzle part. The nozzle part is located in the second space, and the introduction part includes an outlet that is configured to discharge steam and that opens towards a direction that is opposite the second space. The introduction part includes an outlet that is configured to discharge steam and that is located in the first space, and the nozzle part is located in the second space. The outlet is configured to face the first space.

The outlet is configured to open in a direction that faces the first space and that is opposite the second space. The outlet is configured to open in a direction that faces the first space and that is opposite the nozzle part. The outlet is located within the gap. The main body part includes an upper body that includes the nozzle part and the partition wall; and a lower body that includes the introduction part and the condensed water discharge part and that defines the main body space by coupling to the lower body, where the partition wall and the lower body define the gap. The introduction part includes an outlet that is configured to discharge steam and that is configured to open in a direction that faces the first space, and the nozzle part is located in the second space. The lower body includes an inclined surface that is configured to guide condensed water to the condensed water discharge part, and the partition wall is located at an upper side of the inclined surface.

It is an object of the subject matter disclosed in this application to provide a clothes treatment apparatus that is capable of preventing water from being sprayed into a treatment chamber through a nozzle.

It is another object of the subject matter disclosed in this application to provide a clothes treatment apparatus that is capable of preventing condensed water from being collected in a treatment chamber.

DETAILED DESCRIPTION

Figure 1:
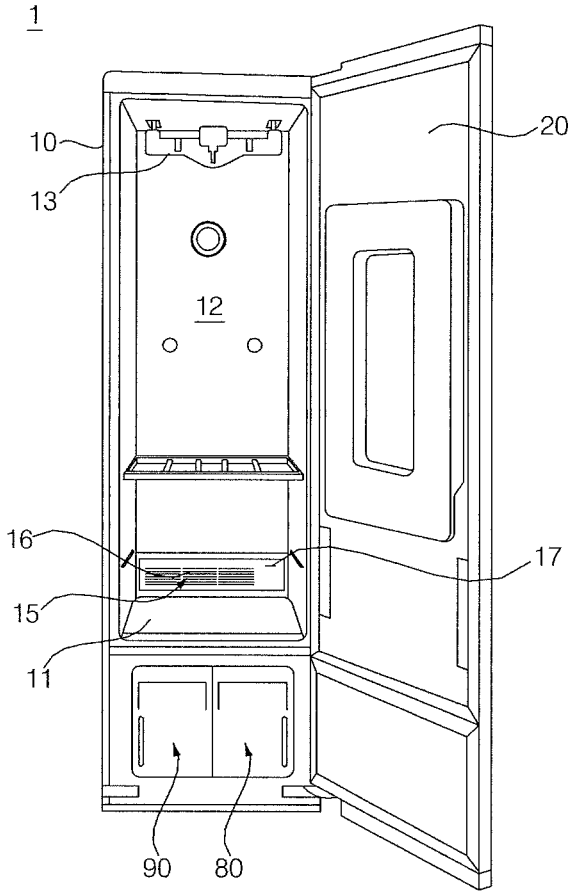
FIG. 1 is a perspective view of an example clothes treatment apparatus.
Figure 2:
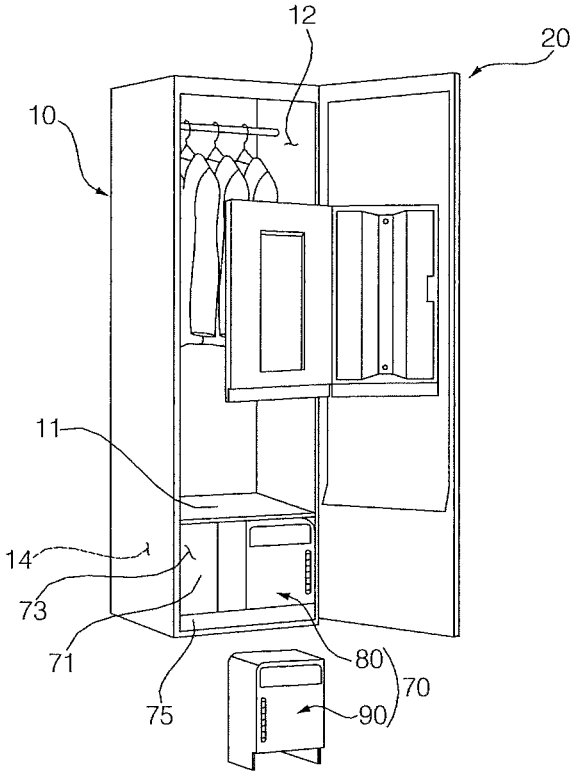
FIG. 2 is a front perspective view of an example clothes treatment apparatus.
Figure 3:
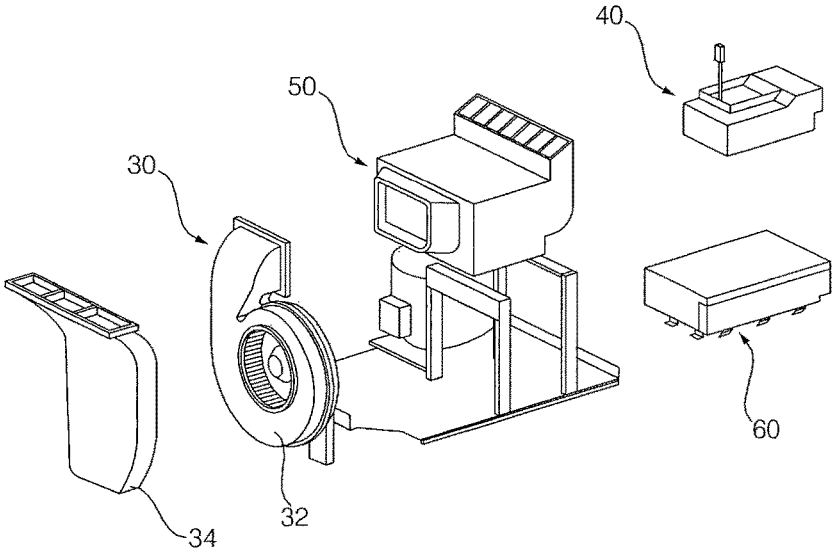
FIG. 3 is an exploded perspective view of an example cycle assembly.
Figure 4:
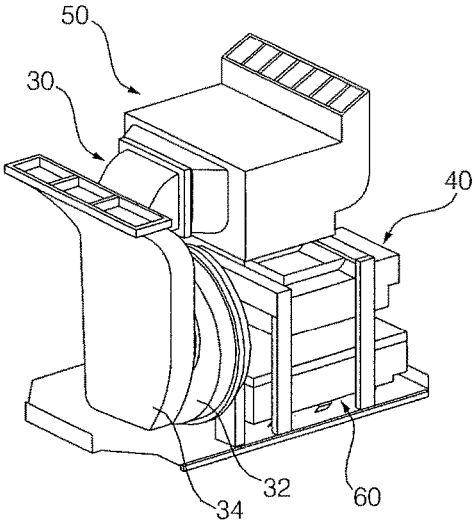
FIG. 4 is a perspective view of an example cycle assembly.
Figure 16:
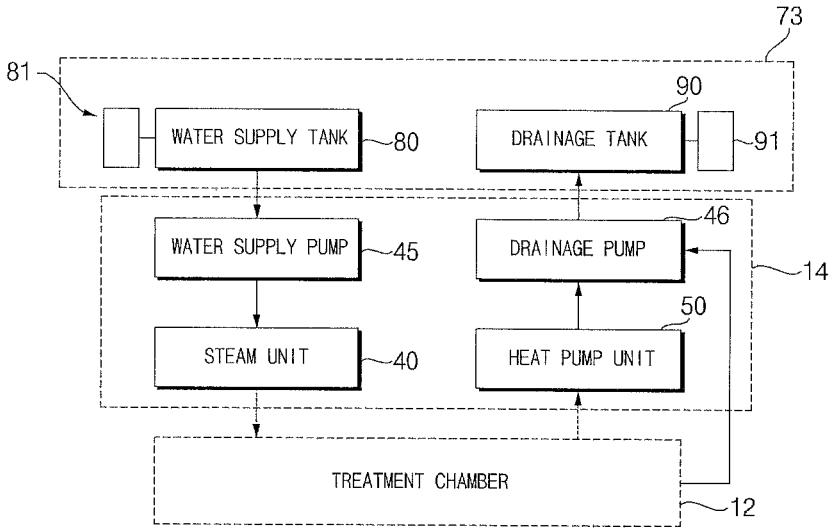
FIG. 16 is a block diagram of an example clothes treatment apparatus.

FIGS. 1, 2, and 16 illustrate example clothes treatment apparatus. FIGS. 3 and 4 illustrate example cycle assemblies.

In some implementations, the clothes treatment apparatus 1 includes a cabinet 10 and a door 20 configured to open and close the front of the cabinet 10.

The interior of the cabinet 10 is partitioned into upper and lower interior parts by a partition plate 11. A treatment chamber 12, in which clothes are hung, is defined in the interior of the cabinet 10 above the partition plate 11. A cycle chamber 14, in which machinery is installed, is defined in the interior of the cabinet 10 below the partition plate 11.

Clothes are hung in the treatment chamber 12. In the treatment chamber 12, wrinkles in the clothes are smoothed, or the clothes are deodorized, by the circulation of steam or air.

A hanger support bar 13 configured to support clothes hangers, on which clothes are hung, is provided in the upper part of the treatment chamber 12. The hanger support bar 13 may be configured to be moved in the treatment chamber 12 in forward and rearward directions, in upward and downward directions, and/or in leftward and rightward directions by a driving device, such as a motor. The hanger support bar 13 may be periodically reciprocated.

An air blowing port 16 and a steam discharge port 17 are formed in the treatment chamber 12.

In some implementations, the air blowing port 16 and the steam discharge port 17 are formed in a discharge panel 15.

In some implementations, the air blowing port 16 and the steam discharge port 17 may be formed in different panels. In some implementations, the discharge panel 15 constitutes a portion of the cycle chamber 14. The discharge panel 15 is located at the rear side of the partition plate 11. The discharge panel 15 and the partition plate 11 form a continuous surface. The discharge panel 15 is inclined toward the partition plate 11.

Air blown by a blowing unit 30 is discharged through the air blowing port 16.

Steam generated by a steam unit 40 is discharged through the steam discharge port 17.

A blowing unit 30 for circulating air in the treatment chamber 12, a steam unit 40 for supplying steam into the treatment chamber 12, a heat pump unit 50 for conditioning air, e.g., cooling, heating, and dehumidification, in the treatment chamber 12, and a control unit 60 for controlling the respective units 30, 40, and 50 are installed in the cycle chamber 14.

In some implementations, an assembly of machinery, including the blowing unit 30, the steam unit 40, the heat pump unit 50, and the control unit 60, which are required to perform respective cycles of the clothes treatment apparatus, is defined as a cycle assembly.

The blowing unit 30 includes a blowing fan 32 and an inlet duct 34.

The inlet duct 34 is installed at the suction side of the blowing fan 32 to guide air in the treatment chamber 12 to the blowing fan 32.

The blowing fan 32 is rotated to blow air. The blowing fan 32 suctions air from the treatment chamber 12, and discharges the suctioned air to the heat pump unit 50.

When the steam unit 40 is powered on, heat is generated from the steam unit 40. The steam unit 40 converts water supplied from a water supply tank 80, which will be described hereinafter, into steam. The generated steam is discharged into the treatment chamber 12.

In some implementations, a flow channel is defined such that the steam flows into the treatment chamber 12 via the heat pump unit 50.

The heat pump unit 50 constitutes a heat pump cycle including a compressor, a condenser, an evaporator, and an expansion valve. Based on the operation mode of the heat pump unit 50, cooled air or heated air may be discharged into the treatment chamber 12.

In some implementations, the heat pump unit 50 may heat air around the condenser through heat exchange with a refrigerant, and may supply the heated air into the treatment chamber 12 through the blowing unit 30. The high-temperature air, which is supplied into the treatment chamber 12, is used to treat clothes that are hung on the clothes hangers, which are supported by the hanger support bar 13. In some implementations, which the heat pump unit 50 is not operated, but only the blowing unit is operated, room-temperature air is supplied into the treatment chamber 12. In addition, air cooled by the evaporator may be supplied into the treatment chamber 12 through the blowing unit 30.

The heat pump unit 50 may dehumidify the air in the treatment chamber 12.

A tank module 70 for storing water is installed in front of the cycle chamber 14. The tank module 70 includes a water supply tank 80 for supplying water to the steam unit 40 and a drainage tank 90 for collecting and storing condensed water that is generated in the treatment chamber 12.

A water supply level sensor 81 for sensing the level of water stored in the water supply tank 80 is installed in the water supply tank 80, and a drainage level sensor 91 for sensing the level of water stored in the drainage tank 90 is installed in the drainage tank 90.

Water from the water supply tank 80 flows to the steam unit 40 via a water supply pump 45.

Water that is condensed in the treatment chamber 12 flows to the lower side of the treatment chamber 12 due to gravity, and is then pumped to the drainage tank 90 by a drainage pump 46. Water that is condensed in the heat pump unit 50 also flows to the drainage tank 90 via the drainage pump 46.

The water supply pump 45 or the drainage pump 46 is controlled by the control unit 60.

In some implementations, a tank module frame 71 is installed in front of the inlet duct 34.

A tank installation space 73 is defined between the tank module frame 71 and the door 20. The tank module frame 71 is coupled to the partition plate 11 to isolate the cycle chamber 14 from the outside.

A tank support bar 75, which interferes with at least one selected from between the water supply tank 80 and the drainage tank 90, is installed in front of the tank installation space 73.

The tank support bar 75 prevents the water supply tank or the drainage tank 90 from being unintentionally separated from the tank installation space 73. The tank support bar 75 supports the front of the water supply tank 80 and the front of the drainage tank 90.

When the door 20 is opened and closed, therefore, the water supply tank 80 and the drainage tank 90 are prevented from being separated from the tank installation space 73.

In some implementations, the lower end of the water supply tank 80 is placed on the upper end of the tank support bar 75, and the lower end of the drainage tank 90 is placed on the upper end of the tank support bar 75.

A tank support end 79, which interferes with the tank support bar 75, is formed on at least one selected from between the water supply tank 80 and the drainage tank 90.

The tank support end 79 is concavely recessed.

The front of the tank support bar 75 and the front of the water supply tank 80 may form a continuous surface due to the tank support end 79. In addition, the front of the tank support bar 75 and the front of the drainage tank 90 may form a continuous surface due to the tank support end 79.

The water supply tank 80 and the drainage tank 90 are disposed in the tank installation space 73 such that the water supply tank 80 and the drainage tank 90 are arranged parallel to each other in rightward and leftward directions.

When the door 20 is opened, the water supply tank 80 and the drainage tank 90 are exposed to a user.

The water supply tank 80 and the drainage tank 90 may be withdrawn by the user.

The water supply tank 80 and the drainage tank 90 may be separated from the tank module frame 71. The water supply tank 80 and the drainage tank 90 may be separably mounted in the tank installation space 73.

The water supply tank 80 is connected to the steam unit 40 to supply water to the steam unit 40. The drainage tank 90 is connected to the treatment chamber 12 to store water discharged from the treatment chamber 12 or the heat pump unit 50.

The drainage tank 90 is identical in function to the water supply tank 80. The drainage tank 90 is disposed alongside the water supply tank 80.

Figure 5:
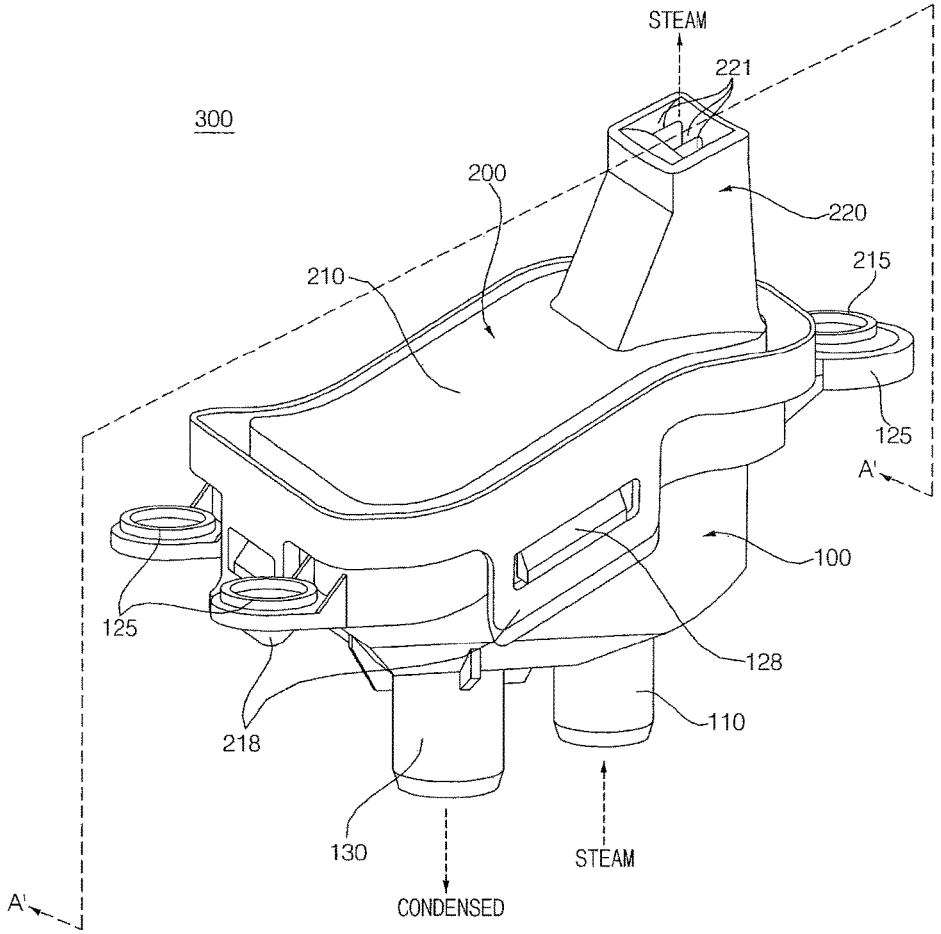
FIG. 5 is a perspective view of an example steam spray device.
Figure 6:
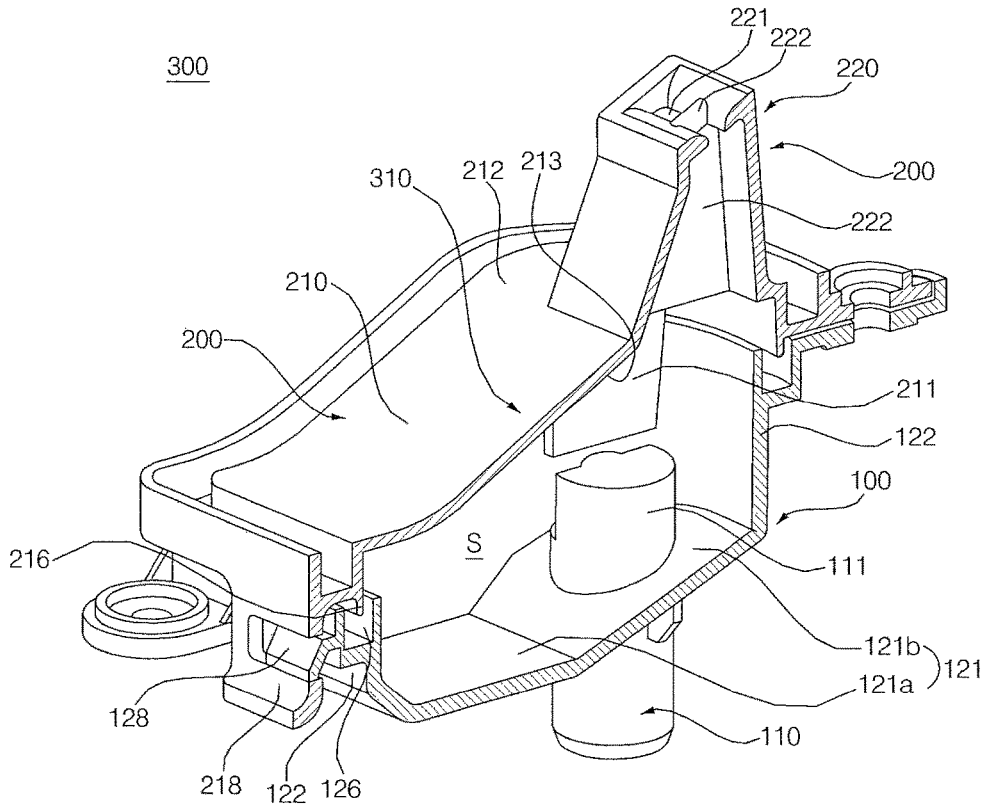
FIG. 6 is a sectional perspective view of an example spray device taken along line A-A' of FIG. 5.
Figure 7:
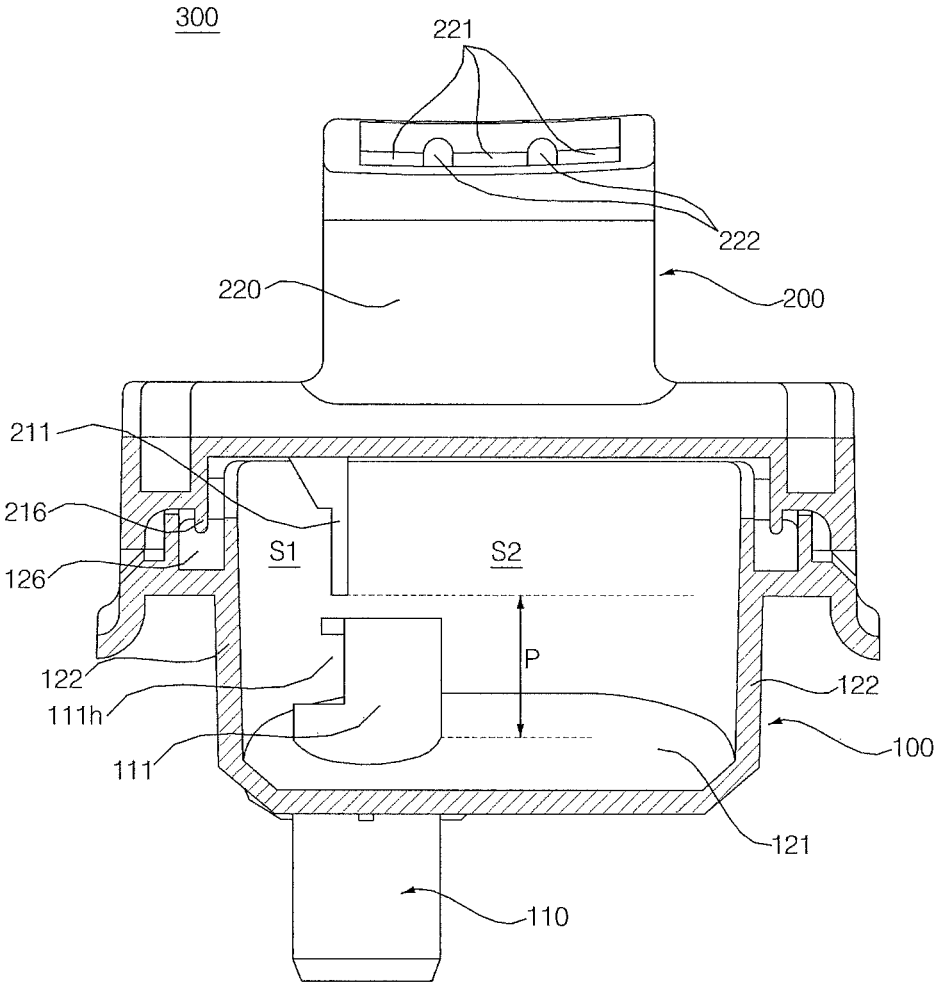
FIG. 7 is a sectional perspective view of an example spray device taken in a direction perpendicular to line A-A' of FIG. 5.
Figure 8:
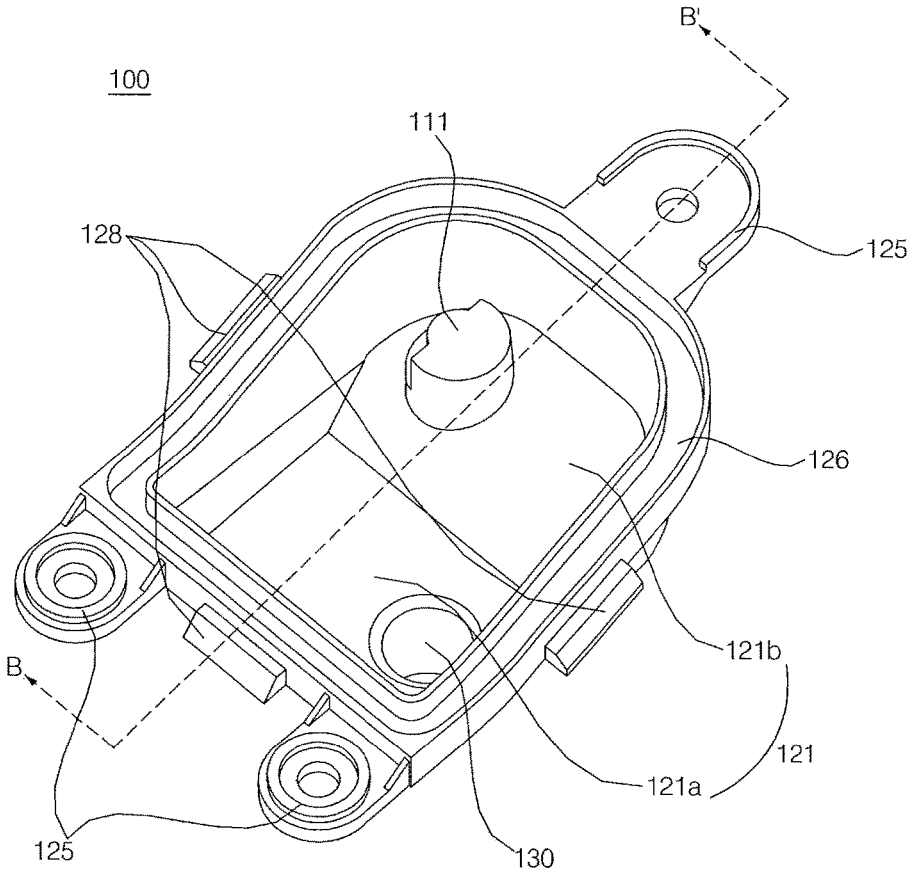
FIG. 8 is a perspective view showing an example lower body of an example steam spray device.
Figure 9:
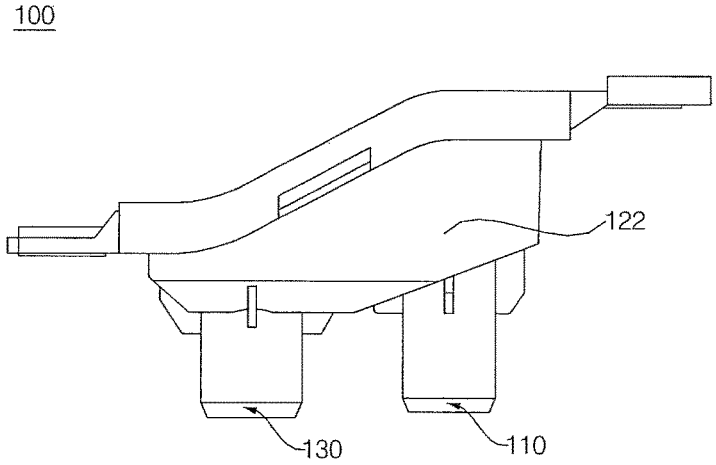
FIG. 9 is a side view of an example lower body of an example steam spray device.
Figure 10:
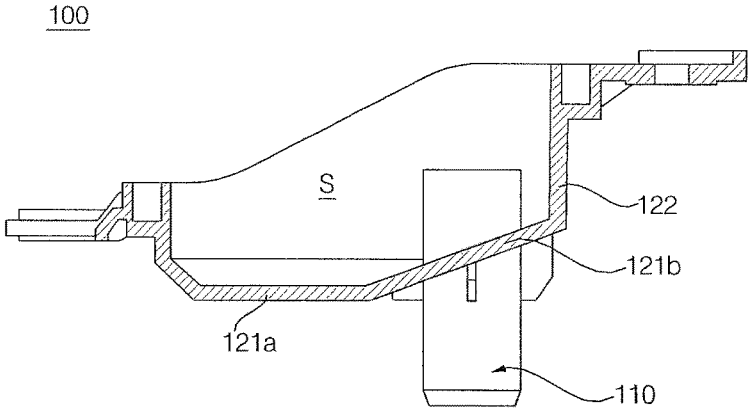
FIG. 10 is a sectional view of an example lower body taken along line B-B' of FIG. 8.
Figure 11:
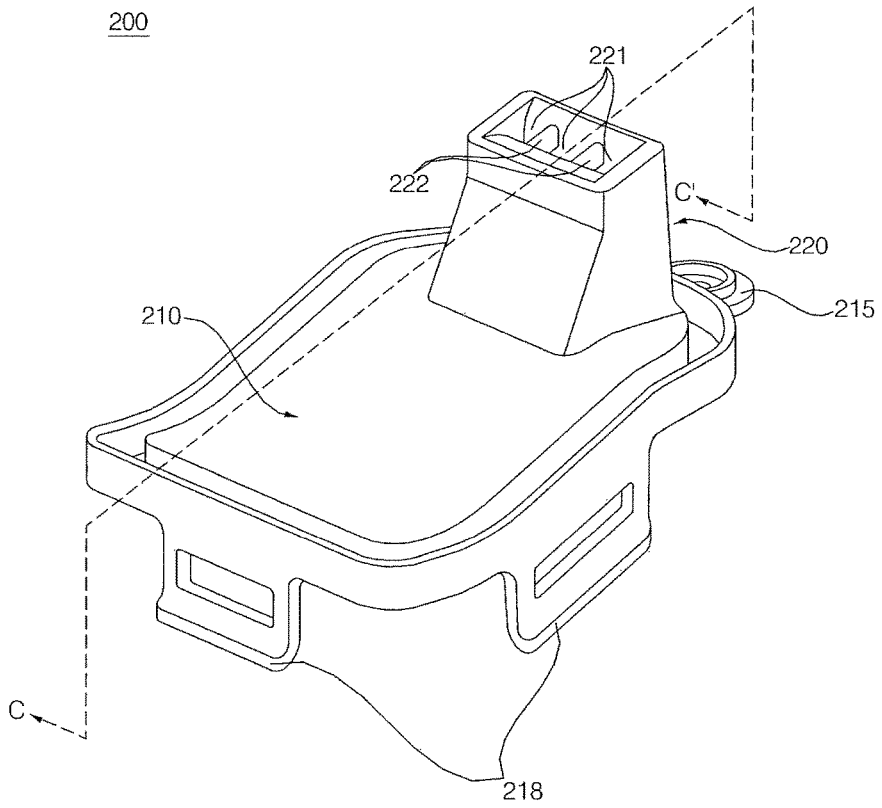
FIG. 11 is a perspective view of an example upper body of an example steam spray device.
Figure 12:
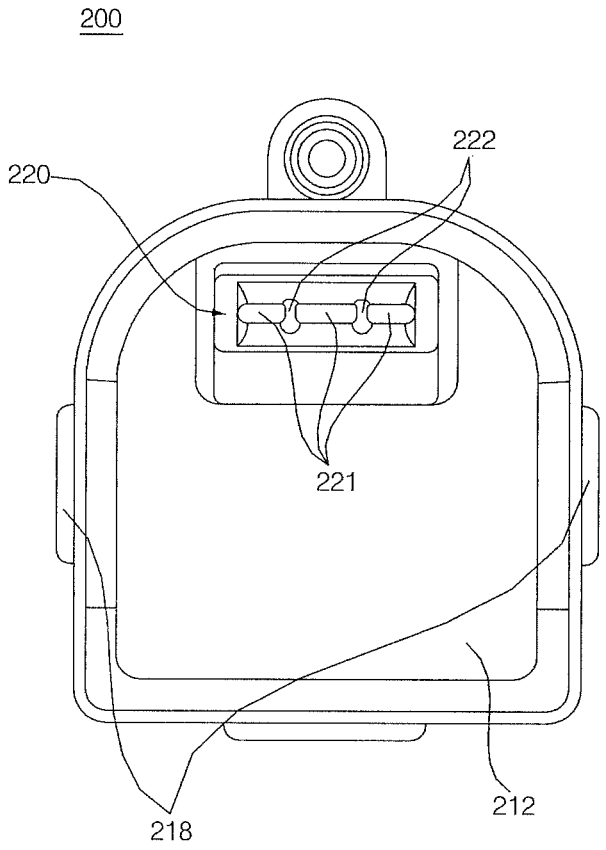
FIG. 12 is a plan view of an example upper body of an example steam spray device.
Figure 13:
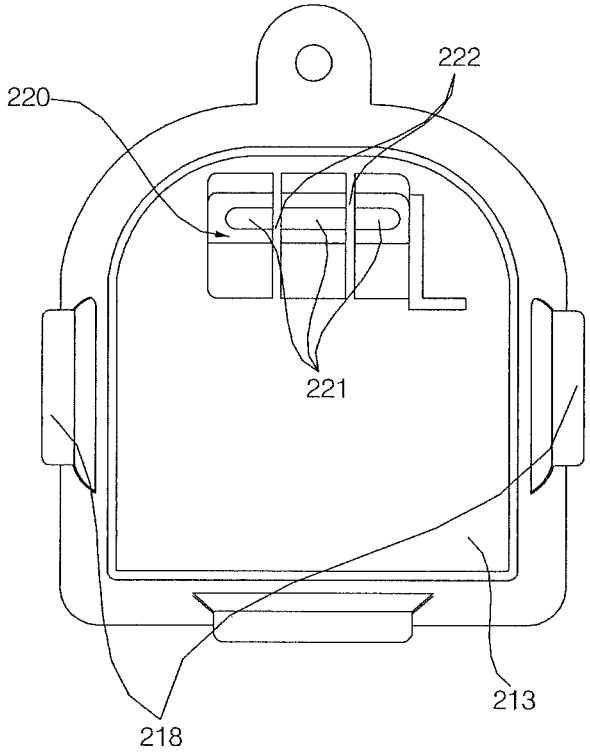
FIG. 13 is a bottom view of an example upper body of an example steam spray device.
Figure 14:
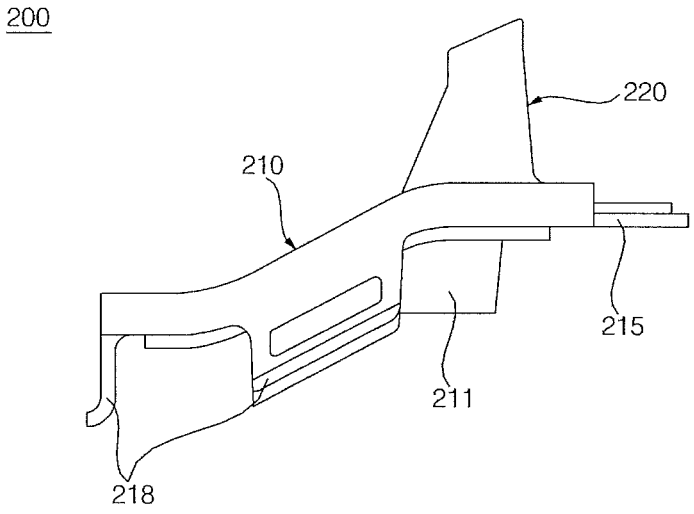
FIG. 14 is a side view of an example upper body of an example steam spray device.
Figure 15:
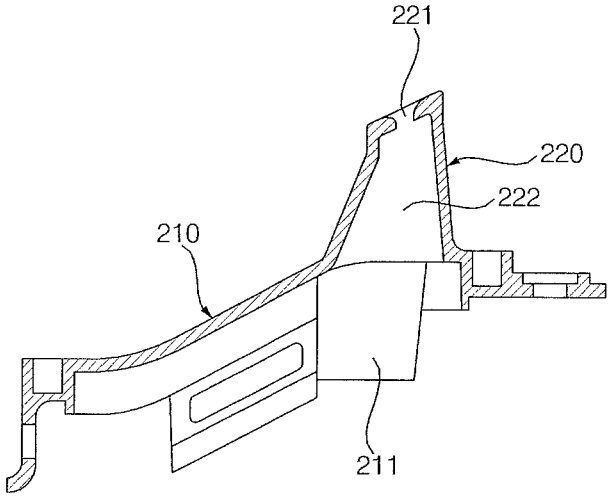
FIG. 15 is a sectional view of an example upper body taken along line C-C' of FIG. 11.

FIGS. 5-7 illustrate example steam spray devices. FIGS. 8-10 illustrate example lower bodies of example steam spray devices. FIGS. 11-15 illustrate example upper bodies of example steam spray devices.

When steam generated by the steam unit 40 is supplied to the steam spray device 300, the steam spray device 300 sprays the received steam into the treatment chamber 12.

The steam spray device 300 includes an introduction part 110, through which steam is introduced, a nozzle part 220 for discharging the steam introduced through the introduction part 110 into the treatment chamber 12, a main body part 310 for guiding the steam supplied through the introduction part 110 to the nozzle part 220, a space S, which is defined in the main body part 310 and in which the introduction part 110 and the nozzle part 220 are connected to each other, a partition wall 211 formed in the space S such that steam flowing from the introduction part 110 and the nozzle part 220 collides with the partition wall 211, and a condensed water discharge part 130 formed in the main body part 310 for discharging condensed water from the space S.

The introduction part 110 is connected to the steam unit 40. The introduction part 110 defines a flow channel, along which steam generated by the steam unit 40 is guided to the space S.

The introduction part 110 is formed in the shape of a pipe, in which steam flows. In some implementations, at least a portion of the introduction part 110 protrudes into the space S, which is defined in the main body part 310. In some implementations, the introduction part 110 may not protrude into the space S.

An outlet 111*h*, through which steam is discharged, is formed in a portion 111 of the introduction part 110 that protrudes into the space S. In addition, an inlet of the introduction part 110, through which steam is introduced, is formed outside the main body part 310. A flow channel defining member, such as a hose or a pipe, may be coupled to the inlet of the introduction part 110. The flow channel defining member may be connected to the steam unit 40.

The space S is defined in the main body part 310. The other parts of the main body part 310, excluding the introduction part 110, the nozzle part 220, and the condensed water discharge part 130, are sealed.

The main body part 310 may be formed as a single member. In some implementations, the steam spray device 300 includes a lower body 100 and an upper body 200.

The steam spray device 300 is defined by a bottom part 121 and a side part 122 of the lower body 100 and a cover part 210 of the upper body 200. Condensed water is collected on the bottom part 121. The side part 122 extends upward from the perimeter of the bottom part 121.

The partition wall 211 partitions the space S, which is defined in the main body part 310, into at least two parts. The partition wall 211 partitions only a portion of the space S. The remaining portions of the space S are connected to each other.

The partition wall 211 interferes with steam that flows in the main body part 310. The partition wall 211 interferes with steam that flows the shortest distance, with the result that the movement path of the steam is complicated.

The partition wall 211 is provided to prevent condensed water in the space S from directly moving to the nozzle part 220. The partition wall 211 maximally prevents condensed water from flowing to the nozzle part 220 due to pressure.

The partition wall 211 partitions the space S into a first space S1, in which the introduction part 110 is located, and a second space S2, in which the nozzle part 220 is located. Partitioning, achieved by the partition wall 211, does not completely prevent the flow of steam between the first space S1 and the second space S2, but defines a gap P, through which steam flows.

The gap P is defined between the partition wall 211 and the bottom part 121. The first space S1 and the second space S2 communicate with each other through the gap P. In some implementations, the partition wall 211 does not extend to the bottom part 121, but the gap P is defined between the partition wall 211 and the bottom part 121. In some implementations, the partition wall 211 may protrude from the bottom part 121. In some implementations, the gap P may be defined between the partition wall extending from the cover part 210 and the partition wall extending from the bottom part 121.

In addition, the partition wall may be disposed such that the cover part 210 and the bottom part 121 are connected to each other via the partition wall. In some implementations, holes or openings may be formed through the partition wall such that steam can flow through the holes or openings.

As described above, the partition wall 211 may be configured to have various shapes.

In some implementations, the introduction part 110 is disposed in the first space S1, and the condensed water discharge part 130 is disposed in the second space S2. The condensed water discharge part 130 may be disposed in a portion of the space S excluding the first space S1.

This is because, if the condensed water discharge part 130 is disposed in the first space S1, condensed water and steam may be discharged simultaneously.

The partition wall 211 partitions a portion of the space S into left and right parts on the basis of the main body part 310.

The partition wall 211 is formed only at a portion of the cover part 210. In some implementations, the partition wall 211 is located at the rear of the main body part 310, where the nozzle part 220 is formed.

The partition wall 211 is formed to have a length greater than the length of the nozzle part 220 in forward and rearward directions. The partition wall 211 is formed to have a sufficient length to cover the nozzle part 220.

In front of the partition wall 211, the first space S1 and the second space S2 are connected to each other.

In some implementations, the partition wall 211 is located higher than the outlet 111*h*.

Steam discharged from the introduction part 110 flows from the first space S1 to the second space S2. At this time, the steam collides with the partition wall 211. As a result, condensed water contained in the steam adheres to or collides with the surface of the partition wall 211, and falls to the lower side of the partition wall 211 due to gravity.

The condensed water, colliding with the partition wall 211, falls to the bottom of the main body part 310 (e.g., the bottom part 121 of the lower body 200). That is, the partition wall 211 resists the flow of the steam. Condensed water discharged from the introduction part 110 and condensed water generated in the space S may adhere to the surface of the partition wall 211.

The condensed water discharge part 130 discharges condensed water from the main body part 310. The condensed water discharge part 130 communicates with the space S.

The condensed water discharge part 130 is formed in the shape of a pipe that defines a flow channel in which condensed water flows. An inlet, through which condensed water is introduced, is formed in the bottom part 121 of the main body part 310, and an outlet, through which condensed water is discharged, is formed in a portion of the main body part 310 that extends outward (e.g., downward).

The introduction part 110 discharges steam into the first space S1, which is defined in the main body part 310. In some implementations, the outlet 111*h* of the introduction part 110 is open toward the side part 122. The outlet 111*h* of the introduction part 110 may not face the nozzle part 220. The outlet 111*h* of the introduction part 110 may not face the second space S2. The direction of the outlet 111*h* is defined such that condensed water discharged from the introduction part 110 interferes with the partition wall 211, and then flows to the second space S2.

The outlet 111*h* is located with its back to the nozzle part 220.

The outlet 111*h* is located with its back to the second space S2.

The outlet 111*h* faces a lateral direction.

The outlet 111*h* is located in the first space S1. The introduction part 110 is disposed over the first space S1 and the second space S2. However, the outlet 111*h* is located in the first space S1 such that steam discharged from the introduction part 110 is prevented from directly moving to the second space S2.

Since steam discharged from the introduction part 110 does not directly flow to the second space S2, but interferes with flow resistance (e.g., the side part 122 or the partition wall 211) in the first space S1, condensed water may be more efficiently collected in the first space S1.

In some implementations, the nozzle part 220 is disposed in the second space S2. The nozzle part 220 is located at the space opposite to the first space S1 on the basis of the partition wall 211.

The bottom part 121 may include a water collection surface 121*a*, in which an inlet of the condensed water discharge part 130 is formed, and an inclined surface 121*b*, which is inclined downward toward the water collection surface 121*a*.

In the main body part 310, condensed water drops onto the bottom part 121, and is then introduced into the condensed water discharge part 130 through the inlet thereof. In particular, since the condensed water flows downward to the water collection surface 121*a* along the inclined surface 121*b*, the condensed water may be effectively discharged through the condensed water discharge part 130.

The inclined surface 121*b* may be located under the partition wall 211. At least a portion of the inclined surface 121*b* may be located at the lower side of the partition wall 211.

The nozzle part 220 extends upward from the main body part 310. The nozzle part 220 defines a flow channel, in which steam flows. The flow channel extends from an inlet, through which steam is introduced from the main body part 310, to an outlet 221, through which the steam is sprayed into the treatment chamber 12.

The nozzle part 220 may include a plurality of outlets 221. In some implementations, ribs 222, which extend in a direction in which steam flows, may be formed in the flow channel. Steam may be guided to the outlets 221 along passages defined between the respective ribs 222, and may then be discharged into the treatment chamber 12 through the steam discharge port 17.

The inlet of the nozzle part 220 may be located at the upper side of the inclined surface 121*b*. Since high-temperature steam tends to move upward, it is advantageous for the steam to be guided while moving upward toward the nozzle part 220 along the inclined surface 121*b* in terms of flowability.

The steam spray device 300 may be constituted by at least two parts. In some implementations, the steam spray device 300 includes a lower body 100, in which the introduction part 110 and the condensed water discharge part 130 are formed, and an upper body 200, which is coupled to the lower body 100 to define the space S and in which the nozzle part 220, through which steam is discharged, is formed.

In some implementations, the partition wall 211 may extend downward from the upper body 200 toward the lower body 100, and the lower end of the partition wall 211 may be spaced apart from the lower body 100.

The nozzle part 220 is formed so as to extend through the cover part 210.

The inlet of the nozzle part 220 is formed in the bottom surface 213 (see FIG. 13) of the cover part 210, which covers the space S of the upper body 200. The outlet 221 of the nozzle part 220 extends upward from the top surface 212 of the cover part 210.

The upper body 200 and the lower body 100 may be separably coupled to each other. To this end, a protrusion 128 may be formed at one selected from between the upper body 200 and the lower body 100, and a fastening part 218, which is constrained by the protrusion 128, may be formed at the other selected from between the upper body 200 and the lower body 100. The coupling between the protrusion 128 and the fastening part 218 is a kind of hook coupling. In some implementations the upper body 200 and the lower body 100 are formed of a resin material by injection molding, and the protrusion 128 and the fastening part 218 exhibit a certain amount of elasticity. Consequently, coupling and decoupling between the protrusion 128 and the fastening part 218 may be achieved.

Referring to FIG. 7, the lower body 100 may be provided with a groove 126, which extends along the upper end of the side part 122, and the upper body 200 may be provided with a rib 216, which protrudes downward from the cover part 210 such that the rib 216 corresponds to the groove 126. In a state in which the rib 216 is located in the groove 126, the protrusion 128 and the fastening part 218 are fastened to each other, with the result that the lower body 100 and the upper body 200 are coupled to each other.

Reference numerals 125 and 215 indicate fastening holes, which are formed in the lower body 100 and the upper body 200, respectively, and through which fastening members, such as screws or bolts, are inserted. The fastening members may be inserted through the respective fastening holes, and may then be fastened to predetermined portions of the cabinet 10. As a result, the steam spray device 100 may be fixed to the cabinet 10.

Hereinafter, the flow of steam will be described in more detail.

First, steam supplied through the introduction part 110 is discharged into the space S, which is defined in the main body part 310, through the outlet 111*h*. After the steam is discharged into the space S through the outlet 111*h*, the steam collides with the side part 122 adjacent to the first space S1, with the result that the flow direction of the steam is changed.

Since the steam supplied through the introduction part 110 flows upward, the steam discharged through the outlet 111*h* flows upward.

The steam, after colliding with the side part 122, flows to the bottom surface 213 of the cover part 210 along the side part 122, with the result that the steam collides with the partition wall 211. Since the partition wall 211 extends downward from the cover part 210, the flow direction of the steam is changed after it collides with the partition wall 211.

When the steam collides with the partition wall 211, condensed water contained in the steam drops downward along the partition wall 211 adjacent to the first space S1. The condensed water drops due to gravity. In addition, the flow pressure of the steam is applied to the condensed water. That is, the condensed water formed on the partition wall 211 may rapidly drop onto the bottom part 121 due to the flow pressure of the steam.

The steam discharge through the outlet 111*h* may form a vortex in the first space S1. When the vortex is formed in the first space S1, the condensed water may drop more effectively.

The steam in the first space S1 may flow to the second space S2 due to the pressure difference between the first space S1 and the second space S2. The steam in the first space S1 enters the second space S2 through the gap P, which is defined between the partition wall 211 and the bottom part 121.

Since condensed water is separated from the steam by the partition wall 211 when the steam flows from the first space S1 to the second space S2, the amount of condensed water that flows to the second space S2 may be minimized.

The steam, after flowing to the second space S2, is guided to the nozzle part 220 due to pressure, and is then discharged out of the main body part 210 through the nozzle part 220.

The steam discharged through the nozzle part 220 is supplied to the treatment chamber 12 through the steam discharge port 17.

The nozzle part 220 extends vertically. Even when a small amount of condensed water is stored in the second space S2, therefore, it is possible to maximally prevent the condensed water from being discharged due to gravity and surface tension with the main body part 310.

The condensed water dropped from the partition wall 211 flows to the condensed water discharge part 130 along the bottom part 121. The condensed water, after flowing to the condensed water discharge part 130, is guided to the drainage tank 90 along a drainage channel.

The condensed water in the drainage channel is stored in the drainage tank 90 through the drainage pump 46.

As is apparent from the above description, the clothes treatment apparatus has the following effects.

First, the partition wall maximally prevents steam from being sprayed from the space, which is defined in the main body part, to the treatment chamber.

Second, the flow channel is defined such that the supplied steam collides with the partition wall. Consequently, it is possible to prevent the steam from directly flowing to the nozzle part.

Third, the introduction part, through which steam is introduced, and the nozzle part, through which the steam is discharged, are disposed in different spaces, which are partitioned by the partition wall. Consequently, it is possible to prevent condensed water from flowing to the nozzle part.

Fourth, steam is discharged with its back to the nozzle part or the second space. Consequently, it is possible to prevent condensed water from directly flowing to the nozzle part or the second space.

Fifth, the partition wall is located at the upper side, and the gap, through which steam flows, is defined at the lower side of the partition wall. Consequently, condensed water formed on the partition wall drops downward due to gravity or pressure.

Sixth, the introduction part is located at the lower side of the partition wall, and the outlet, through which steam is discharged, is located in the first space. Consequently, it is possible to maximize the capacity of the first space.

Seventh, the partition wall is formed so as to have sufficient area to cover the nozzle part in the flow channel extending from the introduction part to the nozzle part. Consequently, it is possible to minimize the area of the partition wall.

Eighth, the outlet of the introduction part is located under the partition wall. Consequently, it is possible to spray steam toward the first space, which is formed at the upper side, whereby it is possible to form a vortex in the first space.

Ninth, condensed water is prevented from being sprayed into the treatment chamber. Consequently, it is possible to prevent clothes from being wetted by the condensed water.

Tenth, the amount of condensed water that is sprayed into the treatment chamber is minimized. Consequently, it is possible to maximally prevent the propagation of germs or the generation of bad smells caused by the condensed water remaining in the treatment chamber.

What is claimed is:

1. A clothes treatment apparatus comprising:

a cabinet comprising:

a treatment chamber that is configured to receive clothes;

a steam unit that is located in the cabinet and that is configured to generate steam; and a steam spray device that is located in the cabinet and that is configured to spray steam into the treatment chamber and that comprises:

a main body part that defines a main body space;

an introduction part that is connected to a lower side of the main body part, that communicates with the main body space, and that is configured to allow steam that is generated by the steam unit to enter the main body space;

a nozzle part that is connected to an upper side of the main body part, that communicates with the main body space, and that is configured to discharge steam in the main body space into the treatment chamber;

a condensed water discharge part that is connected to the lower side the main body part and that is configured to discharge condensed water out of the main body space; and a partition wall that extends upward and downward in the main body space, that is connected to the main body part, that is configured to partition at least a portion of the main body space into a first space on a left side of the main body space and a second space on a right side of the main body space, that is configured to define a gap that allows steam to flow from the first space to the second space, and that is configured to change a flow direction of steam flowing from the introduction part to the nozzle part based on steam colliding with the partition wall, wherein the introduction part is located in a lower side of the first space and defines an outlet that is configured to discharge steam and that opens toward the first space, and wherein the nozzle part is located in an upper side of the second space.

2. The clothes treatment apparatus according to claim 1, wherein the condensed water discharge part is located in the second space.

3. The clothes treatment apparatus according to claim 1, wherein the condensed water discharge part is located in a portion of the main body space excluding the first space.

4. The clothes treatment apparatus according to claim 1, wherein the partition wall is configured to extend downward from an inner upper surface of the main body part and defines, along with an inner bottom surface of the main body part, the gap.

5. The clothes treatment apparatus according to claim 1, wherein the partition wall is located above an upper side of the introduction part.

6. The clothes treatment apparatus according to claim 1, wherein the partition wall is longer than the nozzle part.

7. The clothes treatment apparatus according to claim 1, wherein the introduction part is located at a lower side of the partition wall, and is located in the first space and the second space.

8. The clothes treatment apparatus according to claim 1, wherein the introduction part opens toward a side part of the steam spray device that further defines the main body space and that faces a side of the partition wall.

9. The clothes treatment apparatus according to claim 1, wherein:

the outlet is configured to discharge steam away from the nozzle part.

10. The clothes treatment apparatus according to claim 1, wherein:

the outlet is configured to discharge steam away from the second space.

11. The clothes treatment apparatus according to claim 1, wherein:

the outlet is configured to discharge steam and that is located in the first space.

12. The clothes treatment apparatus according to claim 11, wherein the outlet is configured to open in a direction that faces the first space and that is opposite the second space.

13. The clothes treatment apparatus according to claim 11, wherein the outlet is configured to open in a direction that faces the first space and that is opposite the nozzle part.

14. The clothes treatment apparatus according to claim 11, wherein the outlet is located within the gap.

15. The clothes treatment apparatus according to claim 1, wherein the main body part comprises:

an upper body that includes the nozzle part and the partition wall; and a lower body that includes the introduction part and the condensed water discharge part and that defines the main body space by coupling to the lower body, wherein the partition wall and the lower body define the gap.

16. The clothes treatment apparatus according to claim 15, wherein:

the introduction part includes an outlet that is configured to discharge steam and that is configured to open in a direction that faces the first space, and the nozzle part is located in the second space.

17. The clothes treatment apparatus according to claim 15, wherein:

the lower body includes an inclined surface that is configured to guide condensed water to the condensed water discharge part, and the partition wall is located at an upper side of the inclined surface.

* * * * *